US009478928B1

(12) United States Patent
Cao et al.

(10) Patent No.: US 9,478,928 B1
(45) Date of Patent: Oct. 25, 2016

(54) MULTI-FUNCTION CONNECTABLE DATA CABLE

(71) Applicant: Dongguan Elinke Industrial Co., Ltd., Dongguan (CN)

(72) Inventors: Jing Cao, Dongguan (CN); Haotian Shi, Dongguan (CN); Zhenbin Qin, Dongguan (CN); Penghua Xiang, Dongguan (CN); Yi Xian, Dongguan (CN)

(73) Assignee: DONGGUAN ELINKE INDUSTRIAL CO., LTD., Dongguan, Guangdong (CN)

( * ) Notice: Subject to any disclaimer, the term of this patent is extended or adjusted under 35 U.S.C. 154(b) by 0 days.

(21) Appl. No.: 14/746,828

(22) Filed: Jun. 22, 2015

(51) Int. Cl.
*H01R 31/06* (2006.01)
*H01R 27/02* (2006.01)

(52) U.S. Cl.
CPC ..... *H01R 27/02* (2013.01)

(58) Field of Classification Search
CPC ..... H01R 31/06; H01R 31/02; H01R 31/065
See application file for complete search history.

(56) References Cited

U.S. PATENT DOCUMENTS 4,707,043 A * 11/1987 Reed ..... G01V 1/201 439/135
5,340,331 A * 8/1994 Bohlen ..... H02B 1/202 439/502
5,417,593 A * 5/1995 Suzuki ..... H01R 31/00 439/607.14
5,855,494 A * 1/1999 Blaszczyk ..... H01R 31/02 361/735
5,971,799 A * 10/1999 Swade ..... B60R 16/0207 439/502
6,036,533 A * 3/2000 Huang ..... H01R 31/02 439/502
6,500,025 B1 * 12/2002 Moenkhaus ..... H01R 27/00 439/218
6,540,549 B2 * 4/2003 Rupert ..... H01R 25/003 439/215
7,101,221 B1 * 9/2006 Chen ..... H01R 25/16 439/502
7,322,857 B2 * 1/2008 Chen ..... H01R 12/7041 439/623
8,512,053 B2 * 8/2013 Worth ..... H01R 13/60 439/119
8,714,999 B1 * 5/2014 Wu ..... H01R 13/6658 439/502
9,004,951 B2 * 4/2015 Wu ..... H01R 27/00 439/638
2003/0036312 A1 * 2/2003 Liao ..... H02J 7/0042 439/638
2010/0267276 A1 * 10/2010 Wu ..... H01R 31/06 439/502
2012/0003854 A1 * 1/2012 He ..... H01R 13/70 439/188
2012/0196475 A1 * 8/2012 Lin ..... H01R 25/003 439/505
2012/0252277 A1 * 10/2012 Wu ..... H01R 27/02 439/638

* cited by examiner

*Primary Examiner* — Gary Paumen
(74) *Attorney, Agent, or Firm* — Leong C. Lei

(57) ABSTRACT

A multi-function connectable data cable includes a first connector, a second connector, and a cable. The first connector includes a connector main body and an insertion end. The connector main body is provided with a socket for electrically connecting with the insertion end of another data cable. The connector main body is provided with the socket to mate with the insertion end of the first connector of anther same-model data cable, so that several data cables can be electrically connected in series for multi-function use.

4 Claims, 3 Drawing Sheets

MULTI-FUNCTION CONNECTABLE DATA CABLE

BACKGROUND OF THE INVENTION (a) Technical Field of the Invention

The present invention relates to a data transmission technique, and more particularly to a multi-function connectable data cable.

(b) Description of the Prior Art

Along with the development of science and technology, various electronic products are developed accordingly and the apparatuses using USB interfaces become more and more, such as computers, cell phones, MP3 players, PDAs, and the like. These electronic products use the USB interfaces for charging or data transmission. However, a conventional data cable comprises two connectors and a cable connected between the two connectors. One of the connectors is used to connect with a first apparatus, and the other connector is used to connect with a second apparatus. When it is necessary to connect several second apparatuses with the first apparatus and the first apparatus has only one socket, the connection is just done one-by-one. It is unable to connect with several second apparatuses simultaneously. This way is inconvenient for user. Therefore, it is required to improve the existing data cable for enhancing convenience of data transmission and charging. Accordingly, the inventor of the present invention has devoted himself based on his many years of practical experiences to solve these problems.

SUMMARY OF THE INVENTION

The primary object of the present invention is to provide a multi-function connectable data cable to overcome the shortcomings of the prior art. Through a socket provided on a connector main body of a first connector of the data cable to mate with an insertion end of the first connector, so that several same-model data cables can be electrically connected in series for multi-function use.

In order to achieve the aforesaid object, the multi-function connectable data cable of the present invention comprises a first connector, a second connector, and a cable connected between the first connector and the second connector. The first connector comprises a connector main body and an insertion end disposed at a front end of the connector main body. The connector main body of the first connector is provided with a socket mating with the insertion end of the first connector. The socket is adapted to electrically connect with the insertion end of the first connector of another same-model data cable.

Preferably, the second connector is one of a USB3.0 connector, a USB3.1 connector, a USB2.0 connector, a HDMI connector, a MICRO connector, an RJ45 connector, a lightning connector, a 100 W charging connector, and an OTG connector.

Preferably, one end of the cable is connected to the second connector, and another end of the cable is connected to one side of the connector main body of the first connector.

Preferably, the socket is disposed at a rear end of the connector main body of the first connector.

Compared to the prior art, the advantages and effects of the present invention are described hereinafter. The connector main body of the first connector of the data cable is provided with the socket for connection of the insertion end of the first connector of the same model data cable, so that the data cables can be electrically connected in series for multi-function use. In this way, several apparatuses can be connected simultaneously for data transmission or charging, enhancing convenience of use. The structure of the data cable is simple. When in use, it can be connected in series conveniently.

DETAILED DESCRIPTION OF THE PREFERRED EMBODIMENTS

Embodiments of the present invention will now be described, by way of example only, with reference to the accompanying drawings.

Figure 1:
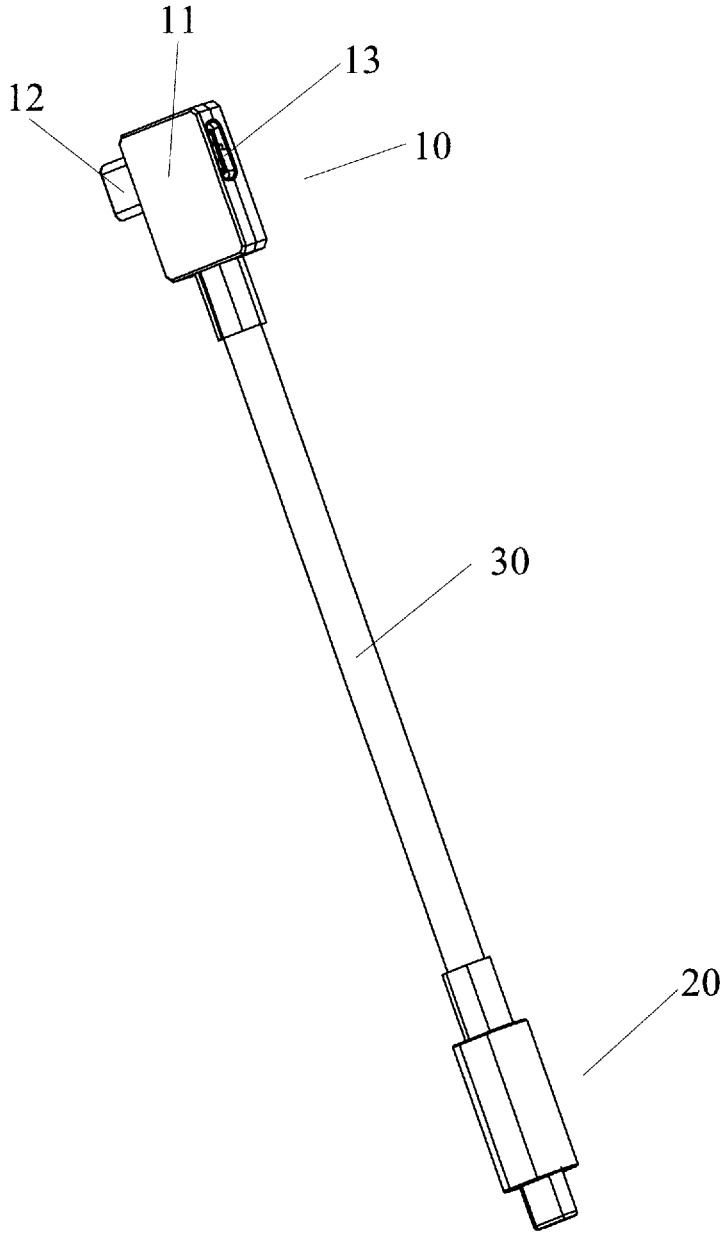
FIG. 1 is a schematic view showing the data cable of the present invention.
Figure 2:
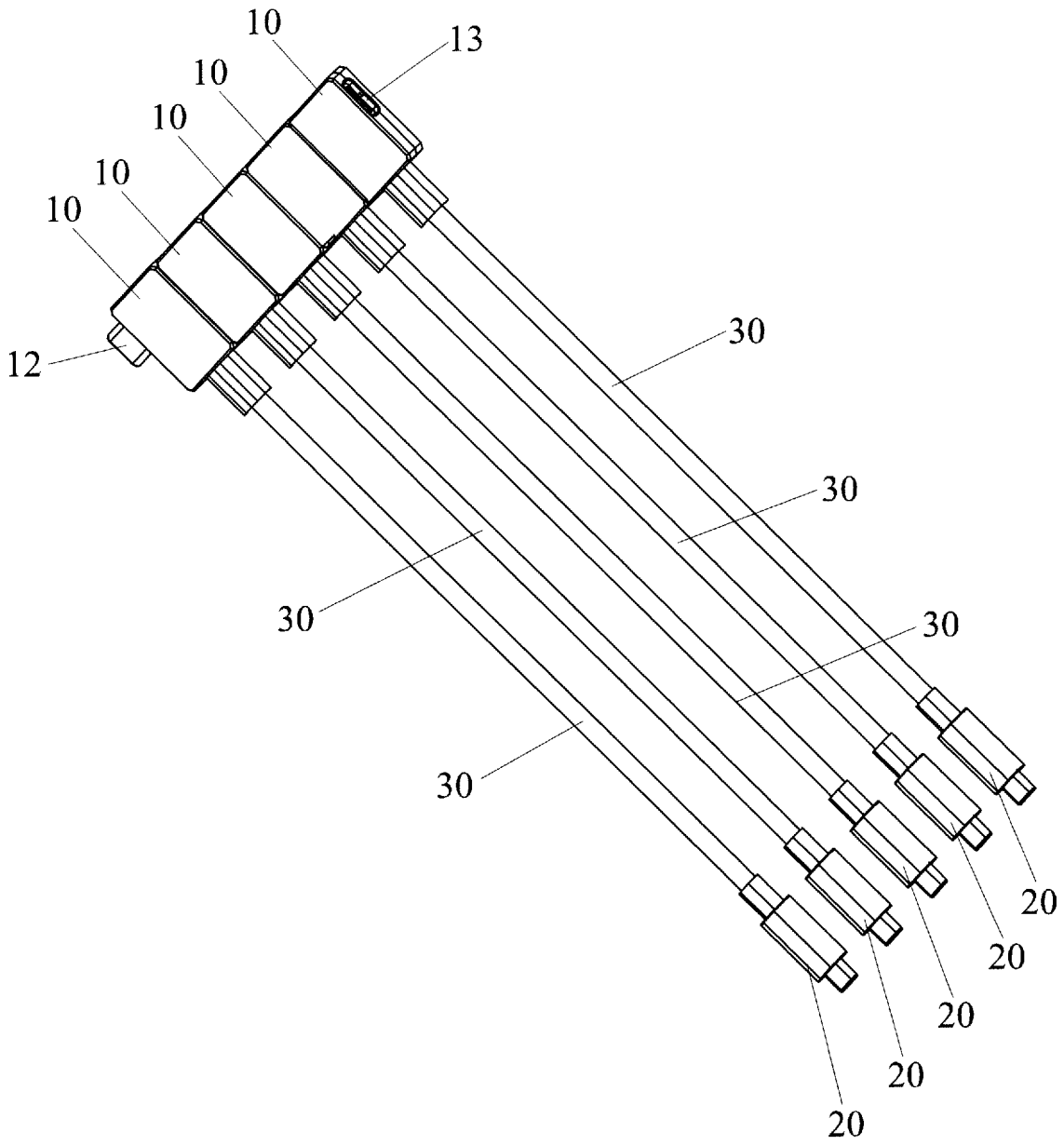
FIG. 2 is a schematic view showing several data cables connected in series of the present invention.
Figure 3:
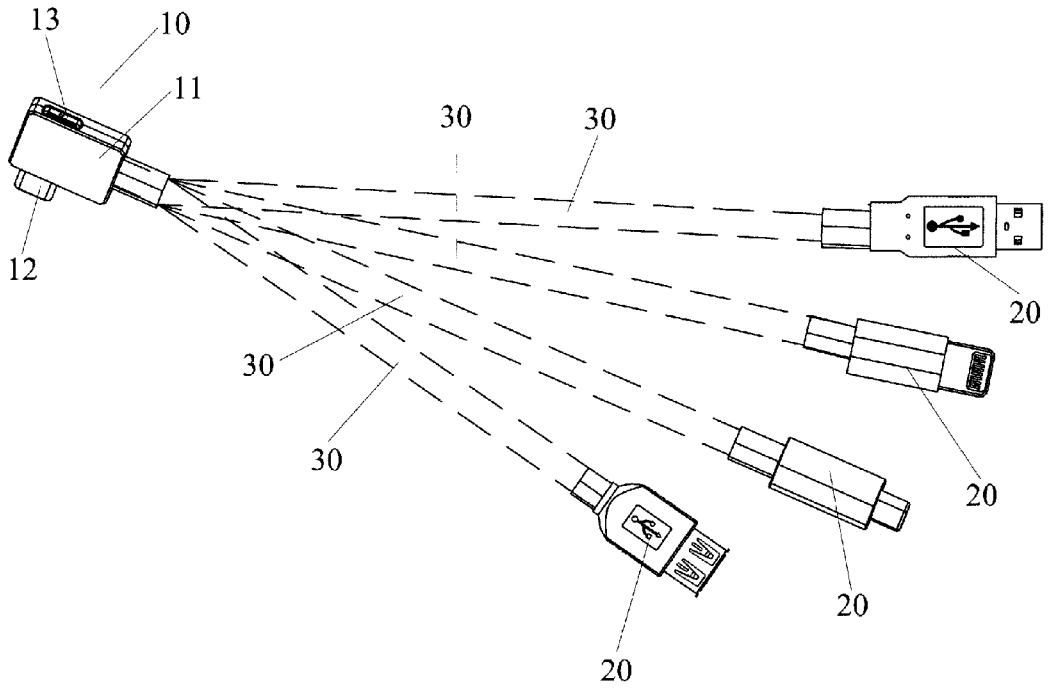
FIG. 3 is a schematic view showing different embodiments of the second connectors of the data cables of the present invention.

As shown in FIG. 1 to FIG. 3, the present invention discloses a multi-function connectable data cable. The multi-function connectable data cable comprises a first connector 10, a second connector 20, and a cable 30 connected between the first connector 10 and the second connector 20.

The first connector 10 comprises a connector main body 11, an insertion end 12 disposed at a front end of the connector main body 111, and a socket 13 for mating with the insertion end 12 of the first connector 10. The socket 13 is adapted to electrically connect with the insertion end 12 of the first connector 10 of another same-model data cable. The second connector 20 can be one of an RJ45 connector, a USB3.0 AF connector, a USB3.0 AM connector, a USB3.1 CM connector, a USB3.1 CF connector, a lightning connector, a USB2.0 AF connector, a USB2.0 AM connector, a MICRO 5P connector, a HDMI AF connector, an OTG connector, and a 100 W charging connector. One end of the cable 30 is connected to the second connector 20, and another end of the cable 30 is connected to one side of the connector main body 11 of the first connector 10. The socket 13 is disposed at a rear end of the connector main body 11 of the first connector 10.

The principle of the present invention is described hereinafter. When it is necessary to connect several second apparatuses with the same first apparatus for data transmission or charging and the number of the socket on the first apparatus is not enough for use, the insertion end 12 of the first connector 10 of one of the data cables is plugged to the socket of the first apparatus, and the socket 13 at the rear end of the first connector 10 is to connect with the insertion end 12 of the first connector 10 of another same-model data cable. As shown in FIG. 2, the insertion ends 12 and the sockets 13 of several data cables can be connected in series, such that several second apparatuses can be connected with the same first apparatus through the second connectors 20. As shown in FIG. 2, the connectors 20 are the same model. The connectors 20 can be any one model as desired, as shown in FIG. 3.

The feature of the present invention is that the connector main body of the first connector of the data cable is provided with the socket for connection of the insertion end of the first connector of the same-model data cable, so that the data cables can be electrically connected in series for multi-function use. In this way, several apparatuses can be connected simultaneously for data transmission or charging, enhancing convenience of use. The structure of the data cable is simple. When in use, it can be connected in series conveniently.

Although particular embodiments of the present invention have been described in detail for purposes of illustration, various modifications and enhancements may be made without departing from the spirit and scope of the present invention. Accordingly, the present invention is not to be limited except as by the appended claims.

We claim:

1. A multi-function connectable data cable, comprising a structure that comprises a first connector, a second connector, and a cable connected between the first connector and the second connector, the first connector comprising a connector main body and an insertion end disposed at a front end of the connector main body, wherein the connector main body of the first connector is provided with a socket connectable to the insertion end of the first connector, and the socket is adapted to electrically connect with the insertion end of the first connector of another data cable having a structure identical to that of the multi-function connectable data cable;

wherein the second connector of the multi-function connectable data cable is of a specification different from a specification of the second connector of said another data cable such that a combination of the multi-function connectable data cable and said another data cable achieved with the insertion end of the first connector of said another data cable electrically connected to the socket of the multi-function connectable data cable comprises two second connectors that are of different specifications to allow for connection with different external connectors such that the first connectors are connected in cascade to form a combined structure to which the two second connectors of different specifications are mounted through the cables.

2. The multi-function connectable data cable as claimed in claim 1, wherein the second connector is one of a USB3.0 connector, a USB3.1 connector, a USB2.0 connector, a HDMI connector, a MICRO connector, an RJ45 connector, a lightning connector, a 100 W charging connector, and an OTG connector.

3. The multi-function connectable data cable as claimed in claim 1, wherein one end of the cable is connected to the second connector, and another end of the cable is connected to one side of the connector main body of the first connector.

4. The multi-function connectable data cable as claimed in claim 1, wherein the socket is disposed at a rear end of the connector main body of the first connector.

* * * * *